US010710835B2

(12) United States Patent
Dunar et al.

(10) Patent No.: US 10,710,835 B2
(45) Date of Patent: Jul. 14, 2020

(54) COLLAR RETENTION SYSTEM FOR PACKAGING DEVICE FOR DISPENSING ELONGATED FLEXIBLE MATERIAL

(71) Applicant: Honeywell International Inc., Morristown, NJ (US)

(72) Inventors: Daniel Dunar, Mequon, WI (US); Brian Meachum, Pleasant Prairie, WI (US)

(73) Assignee: ADEMCO INC., Golden Valley, MN (US)

( * ) Notice: Subject to any disclaimer, the term of this patent is extended or adjusted under 35 U.S.C. 154(b) by 316 days.

(21) Appl. No.: 15/850,076

(22) Filed: Dec. 21, 2017

(65) Prior Publication Data

US 2018/0179016 A1 Jun. 28, 2018

Related U.S. Application Data

(60) Provisional application No. 62/439,627, filed on Dec. 28, 2016.

(51) Int. Cl.
*B65H 49/20* (2006.01)
*B65H 49/32* (2006.01)
(Continued)

(52) U.S. Cl.
CPC ..... *B65H 49/205* (2013.01); *B65H 16/08* (2013.01); *B65H 49/322* (2013.01); *B65H 75/14* (2013.01);
(Continued)

(58) Field of Classification Search
CPC ..... B65H 49/205; B65H 75/14; B65H 16/08; B65H 49/322; B65H 2301/51512;
(Continued)

(56) References Cited

U.S. PATENT DOCUMENTS 216,836 A 6/1879 Crandal
385,931 A 7/1888 Hendryx
(Continued)

FOREIGN PATENT DOCUMENTS

CH 525980 A 7/1972
FR 685641 7/1930
(Continued)

OTHER PUBLICATIONS

Extended European search report for corresponding EP patent application 17210532.2, dated May 24, 2018.
(Continued)

*Primary Examiner* — William A. Rivera
(74) *Attorney, Agent, or Firm* — Husch Blackwell LLP

(57) ABSTRACT

A collar retention system is provided that can be used in connection with a packaging device for dispensing elongated flexible material. Some systems can include one or more of retention collars, retention rings, or an elongated rotatable member around which primary collars can be located that can support the primary collars for resisting outward pressure thereon from the elongated flexible material or to prevent the primary collars from shifting lengthwise along the elongated rotatable member away from a lengthwise center of the elongated rotatable member and towards lengthwise opposing ends of the elongated rotatable member.

12 Claims, 4 Drawing Sheets

(51) Int. Cl.
*B65H 16/08* (2006.01)
*B65H 75/14* (2006.01)

(52) U.S. Cl.
CPC ..... *B65H 2301/51512* (2013.01); *B65H 2701/33* (2013.01); *B65H 2701/35* (2013.01)

(58) Field of Classification Search
CPC ..... B65H 2701/33; B65H 2701/35; B65H 2701/30; B65H 2701/375; B65H 2701/53; B65H 75/18; B65H 75/16; B65H 75/22
See application file for complete search history.

(56) References Cited

U.S. PATENT DOCUMENTS

| | | | | | |
|---|---|---|---|---|---|
| 1,600,196 | A | | 9/1926 | Rutkowski | |
| 1,972,606 | A | | 9/1934 | Strawn | |
| 3,347,489 | A | * | 10/1967 | Poteat, Jr. | B65H 75/14 242/118.61 |
| 3,830,445 | A | * | 8/1974 | Moore | B65H 75/14 242/578.3 |
| 4,607,806 | A | * | 8/1986 | Yealy | B65H 75/14 242/118.7 |
| 6,478,249 | B1 | * | 11/2002 | Orzel | B65H 75/14 242/608.4 |
| 9,169,103 | B1 | * | 10/2015 | Jenkins | B65H 75/4478 |
| 9,446,928 | B2 | | 9/2016 | Meachum et al. | |
| 9,617,127 | B2 | * | 4/2017 | Fuller | B65H 75/14 |
| 2009/0261195 | A1 | * | 10/2009 | Chiorgno | B65H 75/22 242/608.2 |
| 2010/0025521 | A1 | * | 2/2010 | Snitselaar | B65H 75/22 242/608.2 |
| 2013/0284852 | A1 | * | 10/2013 | Fuller | B65H 75/14 242/608.3 |
| 2015/0291386 | A1 | * | 10/2015 | Watkins | B65H 75/22 242/407.1 |
| 2015/0321876 | A1 | * | 11/2015 | Galindo Gonzalez | B65H 75/241 242/611 |
| 2017/0001827 | A1 | * | 1/2017 | Watkins | B65H 75/14 |
| 2017/0008725 | A1 | | 1/2017 | Meachum et al. | |
| 2017/0008726 | A1 | | 1/2017 | Meachum et al. | |

FOREIGN PATENT DOCUMENTS

| | | |
|---|---|---|
| GB | 17042 | 6/1908 |
| GB | 2484987 | 5/2012 |
| WO | WO 2012058543 | 5/2012 |

OTHER PUBLICATIONS

English-language translation of CH patent publication 525980, dated Jul. 31, 1972.
Examination report for corresponding EP patent application 17210532.2, dated Feb. 13, 2019.

* cited by examiner

COLLAR RETENTION SYSTEM FOR PACKAGING DEVICE FOR DISPENSING ELONGATED FLEXIBLE MATERIAL

CROSS-REFERENCE TO RELATED APPLICATIONS

This application claims priority to U.S. Provisional Patent Application No. 62/439,627 filed Dec. 28, 2016 and titled "Two-Step Tube Collar Retention System and Method for Self-Contained Spool Dispensing Packaging." U.S. Application No. 62/439,627 is hereby incorporated by reference.

FIELD

The present invention relates generally to packaging devices for dispensing elongated flexible material. More particularly, the present invention relates to a collar retention system that can be used in connection with a packaging device for dispensing the elongated flexible material.

BACKGROUND

Traditional payout packaging devices for elongated flexible material, such as, for example, cable, wire, rope, chain, strapping, or the like, typically employ an elongated rotatable member, such as a rigid tube or spool, around which the elongated flexible material can be wound, spooled, coiled, or wrapped. The elongated rotatable member can be suspended by stanchions or slots on either side of the elongated rotatable member, and in dispensing the elongated flexible material from such devices, a user can pull a free end of the elongated flexible material, thereby causing the elongated rotatable member to rotate and the elongated flexible material to unwind therefrom. Once a desired portion of the elongated flexible material has been unwound from the elongated rotatable member, the user can cut off a desired amount of the elongated flexible material and leave a remainder of the elongated flexible material on the elongated rotatable member for future use.

For example, each of U.S. Pat. No. 9,446,928, which issued on Sep. 20, 2016, U.S. patent application Ser. No. 15/269,750, which was filed on Sep. 19, 2016, and U.S. patent application Ser. No. 15/269,683, which was filed on Sep. 19, 2016, is titled "Inertia Braking Payout Device and Package System" and discloses a packaging device known in the art. Each of U.S. Pat. No. 9,446,928, U.S. patent application Ser. No. 15/269,750, and U.S. patent application Ser. No. 15/269,683 is assigned to the assignee hereof and is hereby incorporated by reference.

It is known to use a friction fitted collar in connection with the elongated rotatable member as described above. For example, the friction fitted collar can define a portion of the elongated rotatable member onto which the elongated flexible material is wound. However, known friction fitted collars have a tendency to slip when the elongated flexible material wound around the elongated rotatable member exerts an outward force on the collar, for example, when the elongated rotatable member is rotated and the elongated flexible material is unwound therefrom.

In view of the above, there is a continuing, ongoing need for improved systems and methods.

DETAILED DESCRIPTION

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Embodiments disclosed herein can include a collar retention system that can be used in connection with a packaging device for dispensing elongated flexible material. For example, when the collar retention system disclosed herein is used in connection with the packaging device for dispensing the elongated flexible material, a position of a collar on an elongated rotatable member can be held constant throughout a usable life of the collar and the elongated rotatable member. Furthermore, when the collar retention system disclosed herein is used in connection with the packaging device for dispensing the elongated flexible material, friction against stanchions or panels forming slots from which the elongated rotatable member is suspended can be reduced.

Figure 1:
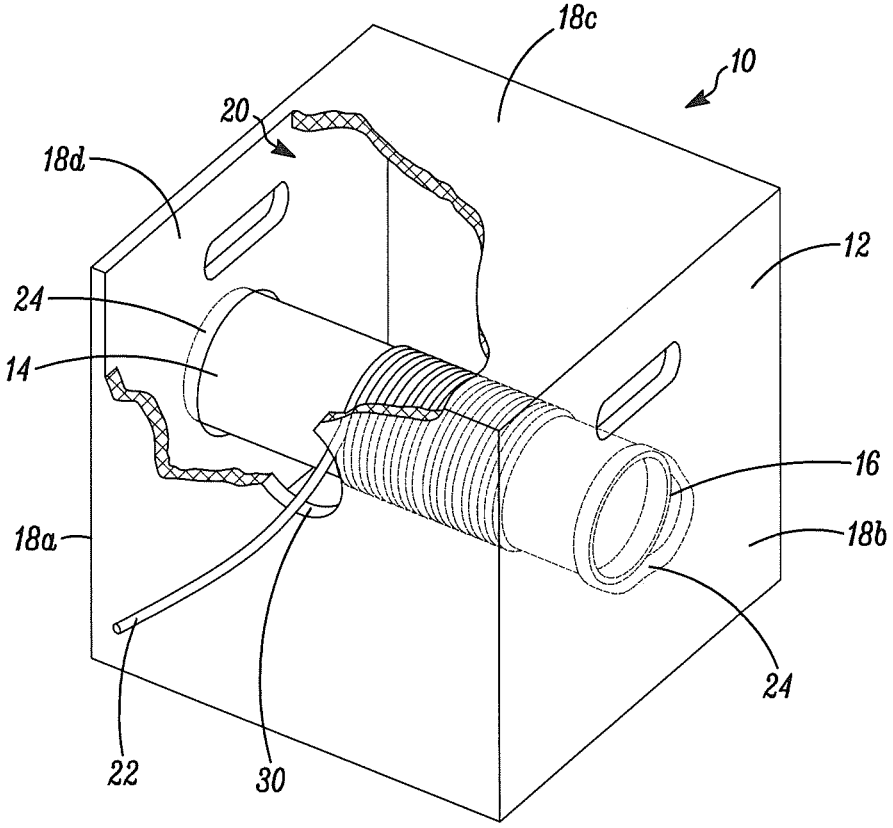
FIG. 1 is a perspective view of a packaging device in accordance with disclosed embodiments.

FIG. 1 is a perspective view of the packaging device 10 in accordance with disclosed embodiments with exterior panels 18*a*-18*d* partially cut away to illustrate interior elements of the packaging device 10. As seen in FIG. 1, the packaging device 10 can include a carton or container 12, the elongated rotatable member 14, such as a rigid tube or spool, and a support structure 16 that includes one or more slots 24 for rotatably supporting at least a portion of the elongated rotatable member 14 within the carton or container 12. For example, the slots 24 can be spaced apart from one another and rotatably support the elongated rotatable member 14 at opposing ends so that a length of the elongated rotatable member 14 spans an interior chamber, cavity, or compartment 20 of the carton or container 12.

The carton or container 12 can include a plurality of panels 18*a*-18*d* joined together at respective end edges and corners and forming the interior chamber, cavity, or compartment 20 for storing the elongated flexible material 22, at least a portion of which can be wound around an exterior surface of the elongated rotatable member 14. At least one of the plurality of panels 18*a*-18*d* can include an opening 30 that provides an egress for the elongated flexible material 22 to exit the carton or container 12.

Figure 2:
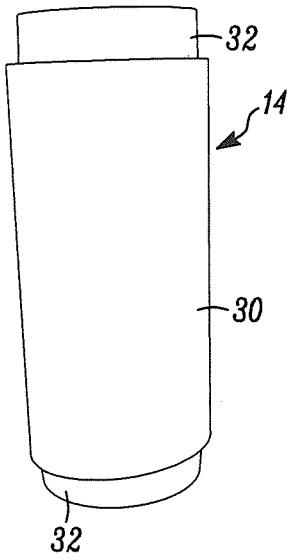
FIG. 2 is a side view of an elongated rotatable member in accordance with disclosed embodiments.

In some embodiments disclosed herein, a lengthwise center of the elongated rotatable member 14 can be thicker than lengthwise opposing ends of the elongated rotatable member 14, and FIG. 2 is a side view of the elongated rotatable member 14 with the lengthwise center thicker than the lengthwise opposing ends in accordance with disclosed embodiments. As seen in FIG. 2, in some embodiments, the elongated rotatable member 14 can include a first tube 30 and a second tube 32. For example, an outer diameter of the second tube 32 can be larger than an outer diameter of the first tube 30, an inner diameter of the second tube 32 can be substantially equal to the outer diameter of the first tube 30, the second tube 32 can be shorter lengthwise than the first tube 30, and the second tube can be placed and secured around the first tube 30 and centered along a length of the first tube 30. Accordingly, the second tube 32 can reinforce a lengthwise center of the first tube 30, and the lengthwise center of the elongated rotatable member 14 can have a higher structural integrity than a structural integrity of the lengthwise opposing ends of the elongated rotatable member 14, which can be beneficial for heavier elongated flexible material 22.

Figure 3:
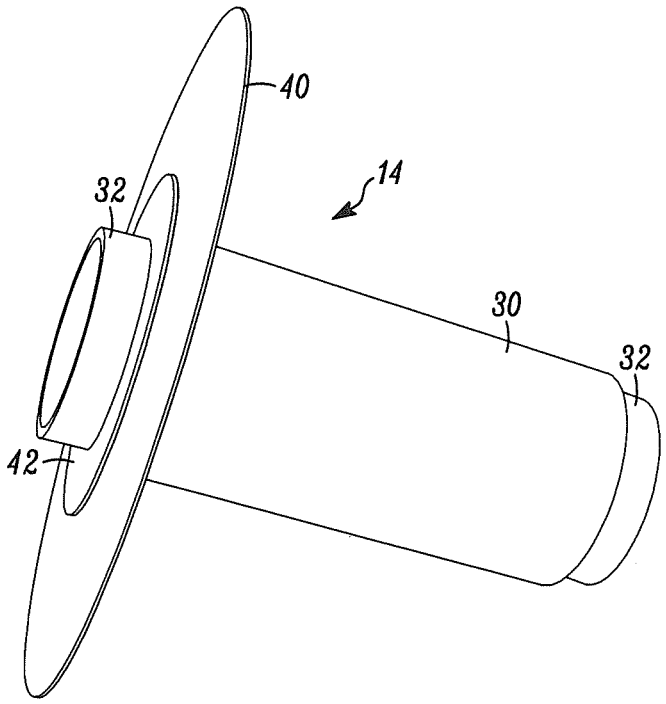
FIG. 3 is a side view of an elongated rotatable member with a primary collar and a retention collar placed thereon in accordance with disclosed embodiments.

In some embodiments, first and second primary collars 40 can be placed around respective ends of the elongated rotatable member 14 and pressed against respective edges of the thicker lengthwise center of the elongated rotatable member 14, that is, respective edges of the second tube 42. Furthermore, in some embodiments, each of the primary collars 40 can be secured in place with a respective one of first and second retention collars 42, which, in some embodiments, can be smaller in diameter than the primary collars 40. For example, FIG. 3 is a side view of the elongated rotatable member 14 with one of the primary collars 40 and one of the retention collars 42 placed thereon in accordance with disclosed embodiments.

Figure 4:
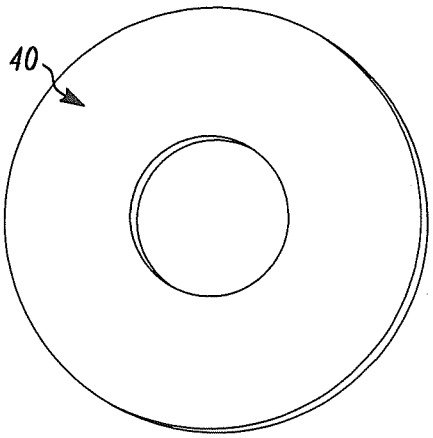
FIG. 4 is a side view of a primary collar in accordance with disclosed embodiments.
Figure 5:
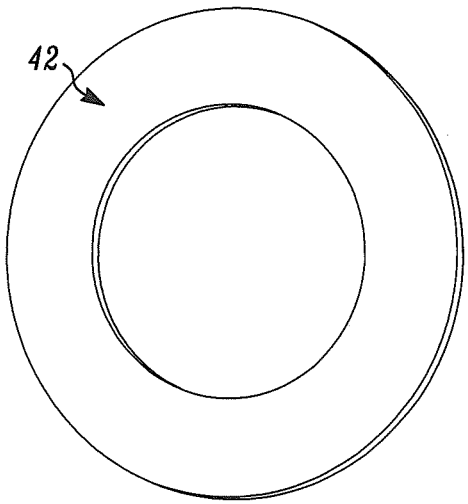
FIG. 5 is a side view of a retention collar in accordance with disclosed embodiments.

FIG. 4 is a side view of one of the primary collars 40 in accordance with disclosed embodiments, and FIG. 5 is a side view of one of the retention collars 42 in accordance with disclosed embodiments. As seen in FIG. 4, in some embodiments, each of the primary collars 40 can include a respective disc-shaped ring with a respective center hole sized to fit around a circumference of the first tube 30 of the elongated rotatable member 14, but not big enough to fit around a circumference of the second tube 32 of the elongated rotatable member 14. As seen in FIG. 5, in some embodiments, each of the retention collars 42 can include a respective disc-shaped ring with a respective center hole that has a diameter equal to the outer diameter of the first tube 30 of the elongated rotatable member 14. In some embodiments, an inner diameter of each of the primary collars 40 can be larger than an inner diameter of each of the retention collars 42, for example, 1-2 inches larger.

In some embodiments, the thicker lengthwise center of the elongated rotatable member 14 can inhibit or prevent the primary collars 40 from being installed too far onto the elongated rotatable member 14 so as to avoid impeding loading or winding the elongated flexible material 22 on the elongated rotatable member 14. Furthermore, in some embodiments, the retention collars 42 can provide support to the primary collars 40 for resisting outward pressure thereon from the elongated flexible material 22 wound on the elongated rotatable member 14 and can inhibit or prevent the primary collars 40 from shifting lengthwise along the elongated rotatable member 14 and towards the lengthwise opposing ends thereof.

In addition or as an alternative to the retention collars 42, in some embodiments, each of the primary collars 40 can be secured in place with a respective one of first and second retention rings, which, in some embodiments, can be smaller in diameter than the primary collars 40. In some embodiments, the retention rings can be secured in place with friction, and in some embodiments, the retention rings can be secured in place with an adhesive. Regardless of the embodiment, it is to be understood that the retention rings can provide the support to the primary collars 40 for resisting the outward pressure thereon from the elongated flexible material 22 wound on the elongated rotatable member 14.

In embodiments that use friction to secure the retention rings in place, a respective center hole of each of the retention rings can be sized so that each of the retention rings fits snugly around the elongated rotatable member 14 to prevent outward movement of the primary collars 40. In embodiments that use the adhesive to secure the retention rings in place, the respective center hole of each of the retention rings can be coated with the adhesive so that each of the retention rings remains in place on the elongated rotatable member 14 to prevent the outward movement of the primary collars 40.

Figure 6:
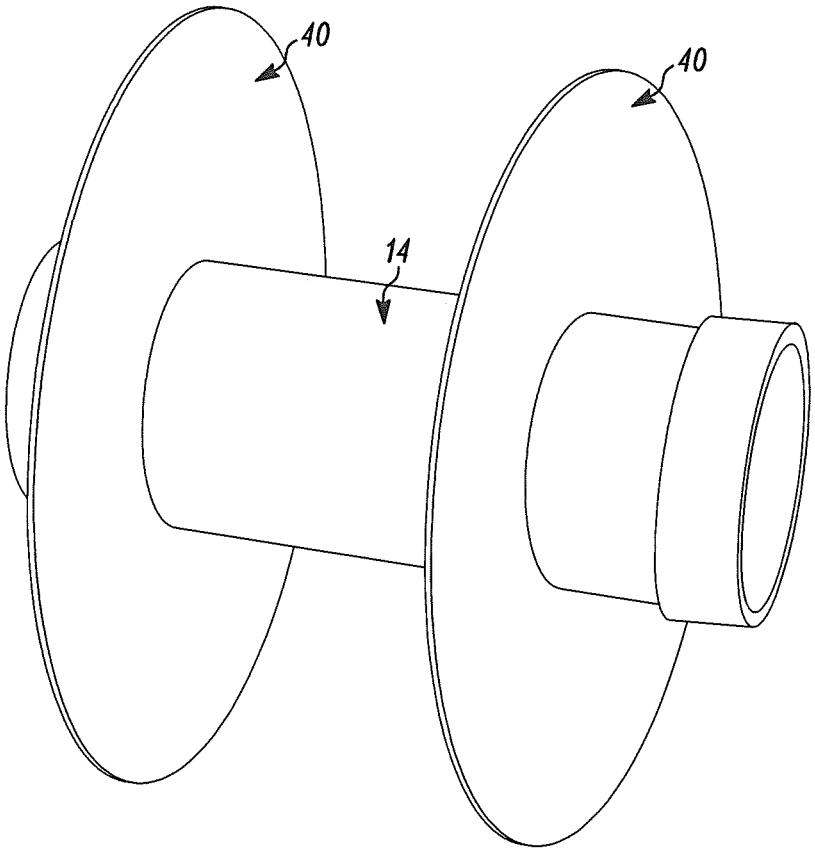
FIG. 6 is a side view of an elongated rotatable member with primary collars placed thereon in accordance with disclosed embodiments.

In some embodiments disclosed, the lengthwise center of the elongated rotatable member 14 can be thinner than the lengthwise opposing ends of the elongated rotatable member 14, and in these embodiments, the first and second primary collars 40 can be placed around the lengthwise center of the elongated rotatable member 14. For example, FIG. 6 is a side view of the elongated rotatable member 14 with the lengthwise center thinner than the lengthwise opposing ends and with each of the primary collars 40 placed around the lengthwise center thereof in accordance with disclosed embodiments. When the outward pressure from the elongated flexible material wound on the elongated rotatable member 14 is applied to the primary collars 40, the primary collars 40 can press against respective interior edges of the thicker lengthwise opposing ends of the elongated rotatable member 14, and those respective interior edges can provide the support to the primary collars 40 to prevent the primary collars 40 from shifting lengthwise too far away from the lengthwise center of the elongated rotatable member 14.

In some embodiments, one or more of the primary collars 40, the retention collars 42, and the retention rings as disclosed herein can be coated with a material suitable for reducing friction against the stanchions or the panels **18*a*-18*d* forming the slots 24 from which the elongated rotatable member 14 is suspended. Furthermore, in embodiments that include the retention collars 42 or the retention rings that are smaller than the primary collars 40 on the elongated rotatable member 14, the retention collars 42 or the retention rings can act as a spacer between the primary collars 40 and the stanchions or the panels 18*a*-18*d* forming the slots 24 from which the elongated rotatable member 14 is suspended, thereby reducing contact area between the primary collars 40 and the stanchions or the panels 18*a*-18*d* forming the slots 24 from which the elongated rotatable member 14** is suspended, which can further reduce friction.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A system comprising:

an elongated rotatable member for receiving elongated flexible material wound around the elongated rotatable member and for dispensing the elongated flexible material therefrom by rotating, wherein the elongated rotatable member includes a first tube and a second tube, and wherein the second tube is shorter lengthwise than the first tube, is located around the first tube, and is centered along a length of the first tube;

a first primary collar located around the first tube proximate to a first lengthwise opposing end of the elongated rotatable member and pressed against a first edge of the second tube;

a second primary collar around the first tube proximate to a second lengthwise opposing end of the elongated rotatable member and pressed against a second edge of the second tube, wherein the first primary collar and the second primary collar define a lengthwise center of the elongated rotatable member onto which the elongated flexible material is wound, and wherein the first primary collar and the second primary collar resist outward pressure thereon from the elongated flexible material;

a first retention collar secured with friction around the first tube proximate to the first lengthwise opposing end of the elongated rotatable member to secure, with friction, the first primary collar in place against the first edge of the second tube for resisting the outward pressure thereon from the elongated flexible material and to prevent the first primary collar from shifting lengthwise along the elongated rotatable member towards the first lengthwise opposing end of the elongated rotatable member; and a second retention collar secured with friction around the first tube proximate to the second lengthwise opposing end of the elongated rotatable member to secure, with friction, the second primary collar in place against the second edge of the second tube for resisting the outward pressure thereon from the elongated flexible material and to prevent the second primary collar from shifting lengthwise along the elongated rotatable member towards the second lengthwise opposing end of the elongated rotatable member.

2. The system of claim 1 wherein a second outer diameter of the second tube is larger than a first outer diameter of the first tube, and wherein an inner diameter of the second tube is equal to the first outer diameter of the first tube.

3. The system of claim 1 wherein the first primary collar includes a first disc-shaped ring with a first center hole sized to fit around a first circumference of the first tube and to be smaller than a second circumference of the second tube, and wherein the second primary collar includes a second disc-shaped ring with a second center hole sized to fit around the first circumference of the first tube and to be smaller than the second circumference of the second tube.

4. The system of claim 1 wherein the first retention collar includes a first disc-shaped ring with a first center hole with a first diameter equal to an outer diameter of the first tube, and wherein the second retention collar includes a second disc-shaped ring with a second center hole with a second diameter equal to the outer diameter of the first tube.

5. The system of claim 1 wherein a first collar diameter of a first collar center hole of the first primary collar is larger than a first retention diameter of a first retention center hole of of the first retention collar, and wherein a second collar diameter of a second collar center hole of the second primary collar is larger than a second retention diameter of a second retention center hole of the second retention collar.

6. The system of claim 1 wherein one or more of the first primary collar, the second primary collar, the first retention collar, and the second retention collar is coated with friction-reducing material.

7. A system comprising:

an elongated rotatable member for receiving elongated flexible material wound around the elongated rotatable member and for dispensing the elongated flexible material therefrom by rotating;

a first primary collar located around and proximate to a first lengthwise opposing end of the elongated rotatable member;

a second primary collar located around and proximate to a second lengthwise opposing end of the elongated rotatable member, wherein the first primary collar and the second primary collar define a lengthwise center of the elongated rotatable member onto which the elongated flexible material is wound, and wherein the first primary collar and the second primary collar resist outward pressure thereon from the elongated flexible material;

a first retention ring secured with friction around the elongated rotatable member proximate to the first lengthwise opposing end of the elongated rotatable member to secure the first primary collar in place on the elongated rotatable member with friction; and a second retention ring secured with friction around the elongated rotatable member proximate to the second lengthwise opposing end of the elongated rotatable member to secure the second primary collar in place on the elongated rotatable member with friction.

8. The system of claim 7 wherein a first retention diameter of the first retention ring is smaller than a first collar diameter of the first primary collar, and wherein a second retention diameter of the second retention ring is smaller than a second collar diameter of the second primary collar.

9. The system of claim 7 wherein a first center hole of the first retention ring fits around the elongated rotatable member to prevent outward movement of the first primary collar, and wherein a second center hole of the second retention ring fits around the elongated rotatable member to prevent the outward movement of the second primary collar.

10. The system of claim 7 wherein one or more of the first primary collar, the second primary collar, the first retention ring, and the second retention ring is coated with friction-reducing material.

11. The system of claim 7 wherein the first primary collar includes a first disc-shaped ring with a first center hole sized to fit around a circumference of the elongated rotatable member, and wherein the second primary collar includes a second disc-shaped ring with a second center hole sized to fit around the circumference of the elongated rotatable member.

12. The system of claim 7 wherein the first retention ring includes a first disc-shaped ring with a first center hole with a first diameter equal to an outer diameter of the elongated rotatable member, and wherein the second retention ring includes a second disc-shaped ring with a second center hole with a second diameter equal to the outer diameter of the elongated rotatable member.

* * * * *